US008925656B2

(12) United States Patent
Shen et al.

(10) Patent No.: US 8,925,656 B2
(45) Date of Patent: Jan. 6, 2015

(54) DIAMOND BONDED CONSTRUCTION WITH REATTACHED DIAMOND BODY

(75) Inventors: Yuelin Shen, Houston, TX (US); Youhe Zhang, Spring, TX (US)

(73) Assignee: Smith International, Inc., Houston, TX (US)

( * ) Notice: Subject to any disclaimer, the term of this patent is extended or adjusted under 35 U.S.C. 154(b) by 633 days.

(21) Appl. No.: 12/903,081

(22) Filed: Oct. 12, 2010

(65) Prior Publication Data

US 2011/0083909 A1 Apr. 14, 2011

Related U.S. Application Data

(60) Provisional application No. 61/250,813, filed on Oct. 12, 2009.

(51) Int. Cl.

| | |
|---|---|
| ***E21B 10/36*** | (2006.01) |
| ***E21B 10/46*** | (2006.01) |
| ***E21B 10/567*** | (2006.01) |
| ***B22F 7/06*** | (2006.01) |
| ***B24D 99/00*** | (2010.01) |
| ***C22C 26/00*** | (2006.01) |
| *B22F 5/00* | (2006.01) |

(52) U.S. Cl.

CPC ..... *E21B 10/5676* (2013.01); *B22F 7/06* (2013.01); *B24D 99/005* (2013.01); *C22C 26/00* (2013.01); *B22F 2005/001* (2013.01)

USPC ..... 175/433; 175/420.2; 175/428; 175/432; 175/434

(58) Field of Classification Search

USPC ..... 175/405.1, 420.2, 426, 428, 432, 433, 175/434; 51/309

See application file for complete search history.

(56) References Cited

U.S. PATENT DOCUMENTS

| | | | | |
|---|---|---|---|---|
| 5,355,969 | A | 10/1994 | Hardy et al. | |
| 5,662,720 | A | 9/1997 | O'Tighearnaigh | |
| 5,875,862 | A | 3/1999 | Jurewicz | |
| 6,042,463 | A | 3/2000 | Johnson | |
| 6,220,375 | B1 | 4/2001 | Butcher et al. | |
| 6,408,959 | B2 | 6/2002 | Bertagnolli et al. | |
| 6,521,174 | B1 | 2/2003 | Butcher et al. | |
| 6,872,356 | B2 | 3/2005 | Butcher et al. | |
| 6,991,049 | B2 | 1/2006 | Eyre et al. | |
| 7,074,247 | B2 | 7/2006 | Tank et al. | |
| 2006/0180354 | A1 | 8/2006 | Belnap et al. | |
| 2006/0266559 | A1 | 11/2006 | Keshavan et al. | |
| 2008/0223623 | A1* | 9/2008 | Keshavan et al. | 175/434 |
| 2009/0152018 | A1* | 6/2009 | Sani | 175/432 |
| 2011/0067930 | A1 | 3/2011 | Beaton | |
| 2011/0083909 | A1 | 4/2011 | Shen et al. | |
| 2011/0297453 | A1 | 12/2011 | Mukhopadhyay et al. | |
| 2012/0225253 | A1 | 9/2012 | DiGiovanni et al. | |

* cited by examiner

*Primary Examiner* — Cathleen Hutchins
(74) *Attorney, Agent, or Firm* — Snell & Wilmer L.L.P.

(57) ABSTRACT

Diamond bonded construction comprise a diamond body attached to a support. In one embodiment, an initial substrate used to sinter the body is interposed between the body and support, and is thinned to less than 5 times the body thickness, or to less than the body thickness, prior to attachment to the support to relieve stress in the body. In another embodiment, the substrate is removed after sintering, and the body is attached to the support. The support has a material construction different from that of the initial substrate, wherein the initial substrate is selected for infiltration and the support for end use properties. The substrate and support include a hard material with a volume content that may be the same or different. Interfaces between the body, substrate, and/or support may be nonplanar. The body may be thermally stable, and may include a replacement material disposed therein.

47 Claims, 4 Drawing Sheets

DIAMOND BONDED CONSTRUCTION WITH REATTACHED DIAMOND BODY

CROSS-REFERENCE TO RELATED APPLICATIONS

This patent application claims priority from U.S. Provisional Patent Applications 61/250,813 filed on Oct. 12, 2009, which is herein incorporated by reference in its entirety.

BACKGROUND OF THE INVENTION

1. Field of the Invention

This invention generally relates to diamond bonded constructions and, more particularly, to diamond bonded constructions that are specially engineered with a diamond body that is attached to a substrate other than the one used for sintering the diamond body at high pressure/high temperature conditions to provide improved performance properties and service life when compared to conventional diamond bonded constructions.

2. Background of the Invention

The use of constructions comprising a body formed from ultra-hard materials such as diamond, polycrystalline diamond (PCD), cubic boron nitride (cBN), polycrystalline cubic boron nitride (PcBN) are well known in the art. An example of such constructions may be found in the form of cutting elements comprising an ultra-hard component or body that is joined to a metallic component or substrate. In such cutting elements, the wear or cutting portion is formed from the ultra-hard component and the metallic portion is provided for the purpose of attaching the cutting element to a desired wear and/or cutting device. In such known constructions, the ultra-hard component may be formed from those ultra-hard materials described above that provide a high level of wear and/or abrasion resistance that is greater than that of the metallic component.

The use of PCD as an ultra-hard material for forming such constructions is well known in the art. PCD is formed by subjecting a volume of diamond grains to high pressure/high temperature (HPHT) conditions in the presence of a suitable catalyst material, such as a solvent catalyst metal selected from Group VIII of the Periodic table. Oftentimes, the source of the solvent catalyst material used to form PCD is the substrate, wherein the solvent catalyst material is present as a constituent of the substrate that migrates therefrom and infiltrates into the adjacent diamond body during HPHT processing. The resulting construction is a PCD compact comprising the PCD body joined to the substrate.

An issue known to exist with such conventional PCD compact constructions is the existence of residual stress within diamond body adjacent the region interfacing with the substrate that is created during HPHT processing. Such residual stress may cause cracking within the diamond body when the compact is placed in a wear or cutting operation that may result in premature compact failure. Additionally, while the substrates used to make such conventional PCD compact constructions may have properties desired to facilitate sintering of the diamond body during HPHT processing, e.g., properties associated with solvent catalyst metal content and/or type, such substrates may not have the most desired properties for the ultimate use of the compact in a wear or cutting operation, e.g., may not have a desired degree of erosion resistance, thereby possibly limiting the effective service life of the compact.

It is, therefore, desirable that diamond bonded constructions be constructed in a manner that provides a reduced or eliminated degree of residual stress when compared to conventional PCD compact constructions. It is also desired that such diamond body constructions be constructed in a manner comprising a substrate having improved end-use service properties when compared to conventional PCD compact constructions. It is further desired that such diamond bonded constructions provide these improved properties without sacrificing desired properties of wear resistance, abrasion resistance, impact resistance, and fracture toughness when compared to conventional PCD compact constructions. It is still further desired that such diamond bonded constructions be produced in a manner that is efficient and does not involve the use of exotic materials and/or techniques.

SUMMARY OF THE INVENTION

Diamond bonded constructions prepared according to principles of the invention comprise a sintered diamond body that is attached to a final substrate or support. The diamond body is sintered under HPHT conditions and comprises a matrix phase of intercrystalline bonded diamond, and a plurality of interstitial regions dispersed within the matrix phase. An initial substrate may be used as a source of a catalyst material for sintering and/or the catalyst material may be provided in powder form and mixed with the diamond powder prior to sintering.

If an initial substrate is used, in one example embodiment it may remain attached to the diamond body after sintering, and is thinned a desired amount to reduce residual stress within the diamond body. In such example embodiment, a final substrate or support is attached to the remaining portion of the initial substrate to form the diamond bonded construction. In an example embodiment it is desired that the thickness of the remaining portion of the initial substrate be less than about 5 times that of the diamond body, and more preferably be less than the thickness of the diamond body.

In a second example embodiment, the initial substrate is completely removed from the diamond body, and the diamond body is subsequently attached to the support to form the diamond bonded constructions.

In both embodiments, it is desired that the support have a material composition that is different than that of the initial substrate. The support and initial substrate may comprise the same hard material. The support may have a volume content of hard material that is the same as or different from the volume content of the hard material in the substrate before sintering the diamond body by HPHT process. The diamond bonded construction may comprise a planar or nonplanar interface between the diamond body and initial or final substrate, and/or a planar or nonplanar interface between the remaining substrate portion and the support or support as needed to provide a desired degree of attachment strength within the construction.

Diamond bonded constructions of this invention may comprise a diamond body that has been treated to render part of or the entire diamond body thermally stable or substantially free of the catalyst material used to form the same. All or a portion of the thermally stable region may include a replacement material disposed therein.

Diamond bonded constructions of this invention have a reduced amount of residual stress when compared to conventional PCD constructions, thereby enhancing the operating life of such constructions. Additionally, the ability to provide a construction having a final substrate or support that is different from the initial substrate enables the tailoring of the construction to provide desired infiltration characteristics during diamond body formation, while at the same time providing superior final substrate properties to meet particular end-use applications, thereby further operating to improve effective service life.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
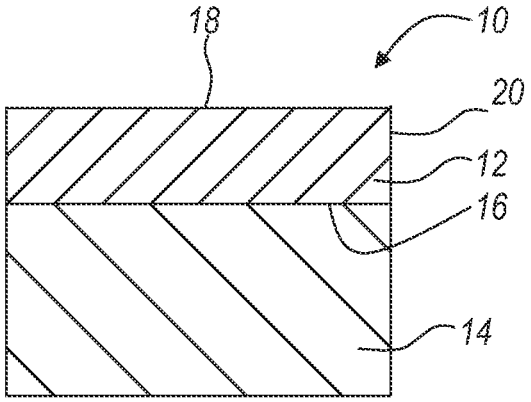
FIG. 1 is a cross sectional side view of a diamond bonded body comprising an initial substrate attached thereto that was used to sinter the diamond bonded body during HPHT processing.

Diamond bonded constructions of this invention comprise a diamond bonded body formed from polycrystalline diamond (PCD). The diamond bonded body may include a region of thermally stable polycrystalline diamond (TSP), wherein such region may or may not comprise an infiltrant material. In one embodiment, a substrate used to initially sinter the diamond bonded body is removed therefrom, and a different final substrate is attached to the diamond body. In another embodiment, the substrate used to initially sinter the diamond body remains attached thereto and is thinned a desired amount before being attached to a different final substrate or support In such example embodiments, the final substrate differs from the initial substrate in its material composition.

While the body has been described above as a diamond bonded body, it is to be understood that the body may be formed ultra-hard materials other than diamond. As used herein, the term "ultra-hard" is understood to refer to those materials known in the art to have a grain hardness of about 4,000 HV or greater. Such ultra-hard materials may include those capable of demonstrating physical stability at temperatures above about 750° C., and for certain applications above about 1,000° C., that are formed from consolidated materials. Such ultra-hard materials may include but are not limited to diamond, cubic boron nitride (cBN), diamond-like carbon, boron suboxide, aluminum manganese boride, and other materials in the boron-nitrogen-carbon phase diagram which have shown hardness values similar to cBN and other ceramic materials.

PCD is an ultra-hard material formed in the manner noted above by subjecting a volume of diamond grains to HPHT conditions in the presence of a catalyst material. The catalyst material may be a solvent catalyst metal, such as one or more selected from Group VIII of the Periodic table. As used herein, the term "catalyst material" refers to the material that was initially used to facilitate diamond-to-diamond bonding or sintering at the initial HPHT conditions used to form the PCD. PCD has a material microstructure comprising a matrix phase of intercrystalline bonded diamond, and a plurality of interstitial regions dispersed within the matrix phase, wherein the catalyst material is disposed within the interstitial regions.

TSP is formed by removing the catalyst material from PCD, so that the remaining diamond structure is substantially free of the catalyst material. TSP has a material microstructure characterized by a matrix phase of intercrystalline bonded diamond, and a plurality of empty interstitial regions. If desired, the empty interstitial regions may be filled with a desired replacement or infiltrant material as described below. Alternatively, TSP may comprise the catalyst material that has been treated to prevent it from acting in a catalytic manner when the diamond body is subjected to high temperature conditions.

Diamond grains useful for forming the diamond bonded body may include natural and/or synthetic diamond powders having an average diameter grain size in the range of from submicrometer in size to 100 micrometers, and more preferably in the range of from about 1 to 80 micrometers. The diamond powder may contain grains having a mono or multimodal size distribution. In an example embodiment, the diamond powder has an average particle grain size of approximately 20 micrometers. In the event that diamond powders are used having differently sized grains, the diamond grains are mixed together by conventional process, such as by ball or attritor milling for as much time as necessary to ensure good uniform distribution.

The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device.

During the HPHT process, a catalyst material, e.g., a solvent metal catalyst or the like, is combined with the diamond powder. In a preferred embodiment, the catalyst material is provided by infiltration from a desired substrate that is positioned adjacent the diamond powder prior to HPHT processing and that includes the catalyst material as a constituent material. Suitable substrates useful for as a source for infiltrating the catalyst material may include those used to form conventional PCD materials, and may be provided in powder, green state and/or already sintered form. A feature of such substrate is that it includes a metal solvent catalyst that is capable of melting and infiltrating into the adjacent volume of the diamond powder to facilitate bonding the diamond grains together during the HPHT process. In an example embodiment, the catalyst material is Co, and a substrate useful for providing the same is a cobalt containing substrate, such as WC—Co.

Alternatively, the diamond powder may be provided in the form of a green-state part or mixture comprising diamond powder that is combined with a binding agent to provide a conformable material product, e.g., in the form of diamond tape or other formable/conformable diamond mixture product to facilitate the manufacturing process. In the event that the diamond powder is provided in the form of such a green-state part, it is desirable that a preheating step take place before HPHT consolidation and sintering to drive off the binder material. In an example embodiment, the PCD material resulting from the above-described HPHT process may have diamond volume content in the range of from about 85 to 95 percent.

The diamond powder or green-state part is loaded into a desired container for placement within a suitable HPHT consolidation and sintering device. The HPHT device is activated to subject the container to a desired HPHT condition to effect consolidation and sintering of the diamond powder. In an example embodiment, the device is controlled so that the container is subjected to a HPHT process having a pressure of 5,000 MPa or greater and a temperature of from about 1,350° C. to 1,500° C. for a predetermined period of time. At this pressure and temperature, the catalyst material melts and infiltrates into the diamond powder mixture, thereby sintering the diamond grains to form PCD. After the HPHT process is completed, the container is removed from the HPHT device, and the so-formed PCD part is removed from the container.

FIG. 1 illustrates a PCD construction 10 prepared in the manner described above comprising a PCD body 12 that is attached to an initial or infiltration substrate 14 during HPHT processing. The initial substrate 14 is selected for the purpose of introducing a desired catalyst material into the diamond volume during the HPHT process to facilitate desired sintering. An interface surface 16 between the PCD body 12 and the initial substrate 14 may be planar or nonplanar.

The PCD body 12 includes top and side surfaces 18 and 20 that may or may not be working surfaces. If desired, the PCD body 12 may have a beveled edge running between the top and side surfaces. The PCD body may be configured having a desired form for a particular end-use application without any further shaping or sizing. Alternatively, the PCD body may initially be configured having a form that facilitates HPHT processing, and then be subsequently shaped or sized as desired for use in the end-use application.

Figure 2:
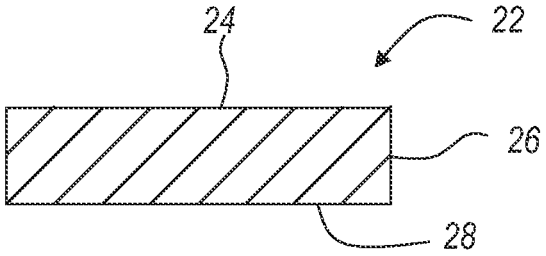
FIG. 2 is a cross sectional side view of a diamond bonded body.

FIG. 2 illustrates a PCD body 22 without an initial or infiltrant substrate attached thereto. The infiltration substrate that was used to form the PCD body (as illustrated in FIG. 1), is removed from the PCD body after sintering for the purpose of joining the body to a desired final substrate or support. The PCD body 22 may include the same surfaces noted above 24 and 26, and may have a planar or nonplanar substrate interface surface 28.

Figure 3:
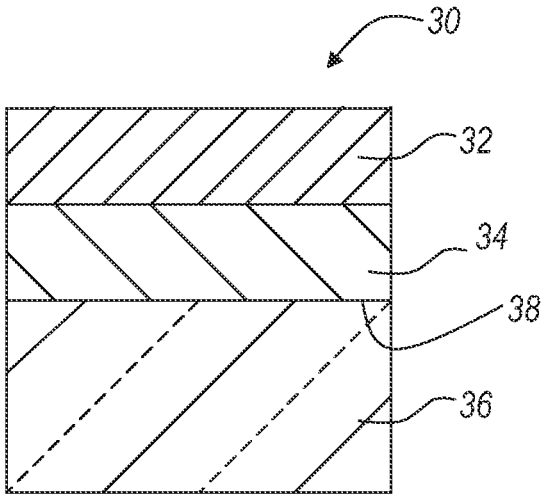
FIG. 3 is a cross sectional side view of an example embodiment diamond bonded construction comprising a diamond bonded body attached to remaining portion of the initial substrate used to sinter the diamond body, wherein the initial substrate is attached to a final substrate.

FIG. 3 illustrates a example embodiment diamond bonded construction 30 comprising a diamond bonded body 32 that is attached to remaining portion 34 of an initial substrate used to sinter the diamond bonded body. This construction may be formed by taking the PCD construction illustrated in FIG. 1, and removing a desired thickness of the initial substrate 34 therefrom by conventional machining process or the like. In an example embodiment, the remaining initial substrate 34 is thinned in an amount that operates to relieve the residual stress existing in the diamond body from the sintering process a desired amount.

In such example embodiment, the remaining initial substrate portion 34 has a thickness that is less than about five times the thickness of the diamond bonded body 32, and in a preferred embodiment has a thickness that is less than that of the diamond bonded body 32. A remaining initial substrate portion 34 having a thickness that is greater than that of the diamond bonded body may not provide the degree of residual stress relief in the diamond bonded body that is desired for a particular end-use application. Ideally, in this example embodiment, it is desired that the amount of the initial substrate removed or thinned be an amount that is effective in providing a desired degree of residual stress relief in the diamond body. Removing more than this amount may not be desired as it adds to the cost of manufacturing and/or contributes to the unwanted waste of materials.

Referring still to FIG. 3, the construction 30 further comprises a final substrate or support 36 that is attached or otherwise joined to the remaining portion 34. An interface surface 38 between the final substrate 36 and the remaining portion 34 may be planar or nonplanar depending on the particular end-use application. In an end-use application calling for a high degree of delamination resistance, a nonplanar interface may be desired to provide an enhanced degree of attachment strength between the final substrate and the remaining initial substrate portion. A construction comprising both a nonplanar interface between the diamond body and the initial substrate remaining portion, and the initial substrate and the final substrate may provide a further degree of enhanced resistance against unwanted delamination during use.

In an example embodiment, the final substrate 36 has a material composition and/or one or more performance properties that are different from that of an infiltration substrate used to form the diamond bonded body. Materials useful for forming the final substrate in such constructions include those useful for forming infiltrant substrates for making conventional PCD materials, such a metallic materials, ceramic materials, cermet materials, and combinations thereof. Example final substrates may be formed from hard materials like carbides such as WC, $W_2C$, TiC, VC, or ultra-hard materials such as synthetic diamond, natural diamond and the like, wherein the hard or ultra-hard materials may include a softer binder phase comprising one or more Group VIII material such as Co, Ni, Fe, and Cu, and combinations thereof.

In an example embodiment, the final substrate may have one or more material properties making it relatively better suited for use of the construction in an end-use application than the infiltration substrate used to initially form the diamond bonded body. For example, the final substrate may have a material composition comprising a lesser amount of a binder material, such as a Group VIII material or the like, than that of the infiltrant substrate, making it less well suited for infiltration and sintering purposes, but providing an improved degree of erosion resistance and thus making it better suited for end-use purposes that are exposed to erosive conditions.

In an example embodiment, the PCD construction may be formed using a WC—Co initial substrate having a WC hard material with a particle size of about 3 microns and having a Co content of about 14 percent by weight prior to sintering of the diamond body. The final substrate may have the same WC particle size but a Co content of about 11 percent by weight. Such an initial substrate includes a Co content that facilitates infiltration and sintering during HPHT processing, while such a final substrate has a reduced Co content that provides a desired improvement in erosion resistance to facilitate end use. It is understood that this description is representative of only one example construction, and that initial and final substrates having constructions and/or properties other than those described may be used to form diamond bonded constructions.

Figure 4:
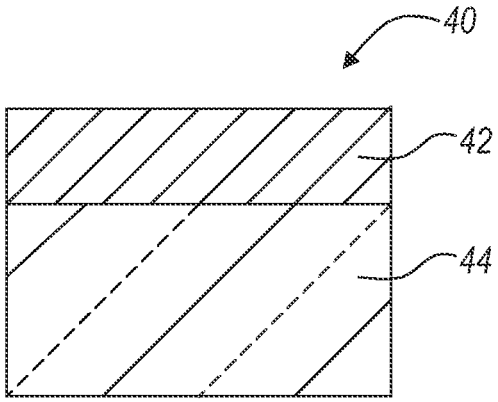
FIG. 4 is a cross sectional side view of an example embodiment diamond bonded construction comprising a diamond bonded body that is attached to a final substrate.

FIG. 4 illustrates an example embodiment diamond bonded construction 40 comprising a diamond bonded body 42 that is attached to a final substrate 44. Unlike the construction embodiment illustrated in FIG. 3, the diamond bonded construction of FIG. 4 does not include a remaining initial substrate portion. In an example embodiment, any initial substrate that was used to sinter the diamond bonded body during HPHT processing is removed, and the resulting diamond bonded body is attached to the final substrate 44. The final substrate may be formed from the same types of materials described above. In this example embodiment, the diamond bonded body is formed using an initial substrate (as illustrated in FIG. 1) as the source of the catalyst material for infiltration, and the infiltrant substrate is subsequently removed from the so-formed diamond bonded body by conventional method and prepared for attachment with the final substrate. The initial and final substrates may be the same as those described above for the embodiment illustrated in FIG. 3.

The final substrate may be attached to the diamond bonded body, in one embodiment, or to a remaining portion of an initial substrate, in another embodiment, by conventional techniques such as by diffusion bonding, brazing, or mechanical locking under HPHT conditions or other appropriate conditions and/or environment. In a preferred embodiment, the final substrate is attached to the diamond bonded body or remaining initial substrate portion by HPHT process to ensure robust bonding and no conversion of diamond into graphite.

If desired, the diamond bonded body may be treated to remove at least a portion of the catalyst material disposed therein, thereby providing a resulting diamond body having improved properties of thermal stability. The particular end-use application will influence the extent and location of catalyst material removed from the diamond bonded body. The term "removed", as used with reference to the catalyst material is understood to mean that a substantial portion of the catalyst material no longer resides within the treated region of the diamond body. However, it is to be understood that some small amount of catalyst material may still remain in the part, e.g., within the interstitial regions and/or adhered to the surface of the diamond crystals. Additionally, the term "substantially free", as used herein to refer to the catalyst material in the treated region of the diamond body, is understood to mean that there may still be some small/trace amount of catalyst material remaining within the treated diamond body as noted above.

In an example embodiment, the diamond bonded body may be treated to remove catalyst material by chemical treatment, such as by acid leaching or aqua regia bath, electrochemical treatment such as by electrolytic process, by liquid metal solubility, or by liquid metal infiltration that sweeps the existing catalyst material away and replaces it with another non-catalyst material during a liquid phase sintering process, or by combinations thereof. In an example embodiment, the catalyst material is removed from the diamond body by an acid leaching technique, such as that disclosed for example in U.S. Pat. No. 4,224,380. Accelerated catalyst removal techniques may be used that involved elevated temperature and/or elevated pressure and/or sonic energy and the like. The diamond bonded body may be subjected to such treatment before or after it is attached to the final substrate.

The treated region of the diamond bonded body comprises a material microstructure having a polycrystalline diamond matrix phase made up of a plurality of diamond grains or crystals that are bonded together, and a plurality of interstitial regions that are disposed between the matrix phase of bonded together diamond grains, and that exist as empty pores or voids within the material microstructure, as a result of the catalyst material being removed therefrom.

In an example embodiment, only a partial region of the diamond body is treated and the treated region extends a desired depth from a surface, which may be a working surface or the bonding surface to the substrate, of the diamond bonded body. In an example embodiment, the depth of such treated region may be about 0.05 mm or less, or may be about 0.05 to 0.4 mm. The exact depth of the treated region will depend on the bonding process and/or end-use application.

If desired, the treated region of the diamond bonded body may be further treated so that all or a population of the interstitial regions within the part, previously empty by virtue of removing the catalyst material therefrom, are filled with a desired replacement or infiltrant material. In an example embodiment, such region may be filled, backfilled or reinfiltrated with a material that operates to minimize and/or eliminate unwanted infiltration of material from the final substrate, and/or that operates to improve one or more properties of the diamond bonded body.

Example replacement or infiltrant materials useful for treating the diamond bonded body may include materials selected from the group including metals, metal alloys, metal carbonates, carbide formers, i.e., materials useful for forming a carbide reaction product with the diamond in the body, and combinations thereof. Example metals and metal alloys include those selected from Group VIII of the Periodic table, examples carbide formers include those comprising Si, Ti, B, and others known to produce a carbide reaction product when combined with diamond at HPHT conditions. The infiltrant material preferably has a melting temperature that is within the diamond stable HPHT window, and may be provided in the form of a powder layer, a green state part, an already sintered part, or a preformed film. The diamond bonded body may be infiltrated during or independently of the process used to attach the diamond bonded body to the final substrate.

It is to be understood that the material selected to form the infiltrant material may permit some degree of substrate constituent infiltration therein, possibly in a sufficient degree to form a desired attachment bond between the diamond bonded body and the final substrate, e.g., during an HPHT attachment process. If desired, the extent of backfilling or infiltrating the diamond bonded body may be controlled to leave a portion of the treated diamond bonded body uninfiltrated. This may either be done, for example, by careful control of the infiltration process or may be done after the diamond bonded body has been completely infiltrated by further treating the infiltrated region of the diamond bonded body to remove the infiltrant from a targeted region. For example, it may be desired that a surface portion of the diamond bonded body, and possibly a region extending from such surface, not include the infiltrant material for the purpose of providing a desired level of thermal stability, abrasion and/or wear resistance. In an example embodiment, such a surface portion of the diamond bonded body may form a surface portion, such as a working surface, of the final diamond bonded construction.

A feature of diamond bonded constructions of this invention is that they have reduced amount of residual stress when compared to conventional PCD constructions that are formed by using and that remain attached to a sintering substrate without further processing. Such reduction in residual stress operates to enhance the operating life of such constructions. Additionally, such diamond bonded constructions may be configured having an additional nonplanar interface, e.g., between the initial and final substrates, that operates to provide an improved degree of delamination resistance, further operating to enhance effective service life. Still further, such diamond bonded constructions include a final substrate that differs from a substrate used as a catalyst material infiltrant source during sintering of the diamond body. In a preferred embodiment, the final substrate is selected to provide improved end-use properties, such as erosion resistance in the like, when compared to conventional PCD constructions comprising only an infiltration substrate, thereby operating to improve effective service life.

Diamond bonded constructions of this invention may be used in a number of different applications, such as tools for mining, cutting, machining, milling and construction applications, wherein properties of shear strength, thermal stability, wear and abrasion resistance, mechanical strength, and/or reduced thermal residual stress are highly desired. Constructions of this invention are particularly well suited for forming working, wear and/or cutting elements in machine tools and drill and mining bits such as roller cone rock bits, percussion or hammer bits, diamond bits, and cutting elements such as inserts, shear cutters and the like used in subterranean drilling applications.

Figure 5:
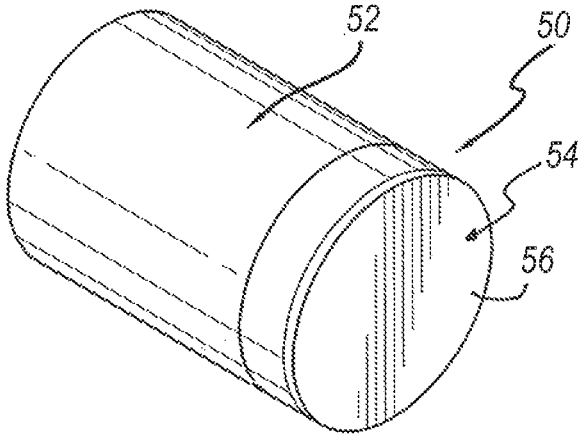
FIG. 5 is a perspective side view of a shear cutter comprising the diamond bonded construction.

FIG. 5 illustrates a diamond bonded construction embodied in the form of a shear cutter 50 used, for example, with a drag bit for drilling subterranean formations. The shear cutter 50 comprises a diamond bonded body 54 as described above. The diamond bonded body is attached to a cutter/final substrate 52. The diamond bonded body 54 includes a working or cutting surface 56. The cutter substrate may include a portion of an initial substrate and a final substrate or may comprise only a final substrate.

Although the shear cutter in FIG. 5 is illustrated having a generally cylindrical configuration with a flat working surface that is disposed perpendicular to an axis running through the shear cutter, it is to be understood that shear cutters formed from diamond bonded constructions may be configured other than as illustrated and such alternative configurations are understood to be within the scope of this invention.

Figure 6:
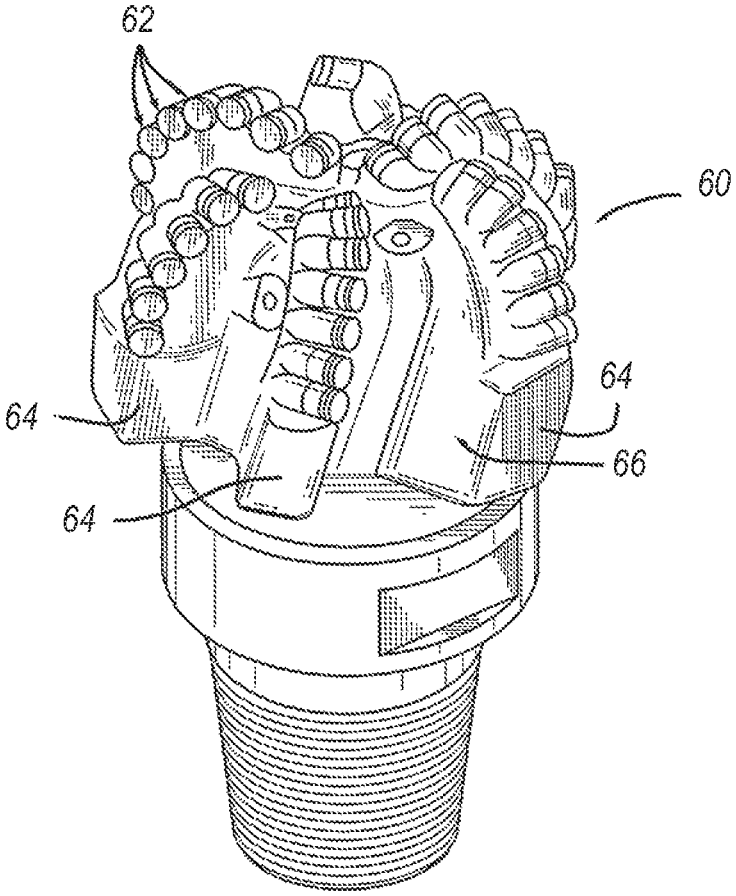
FIG. 6 is a perspective side view of a drag bit comprising a number of the shear cutters of FIG. 5.

FIG. 6 illustrates a drag bit 60 comprising a plurality of the shear cutters 62 described above and illustrated in FIG. 5. The shear cutters are each attached to blades 64 that each extend from a head 66 of the drag bit for cutting against the subterranean formation being drilled.

Figure 7:
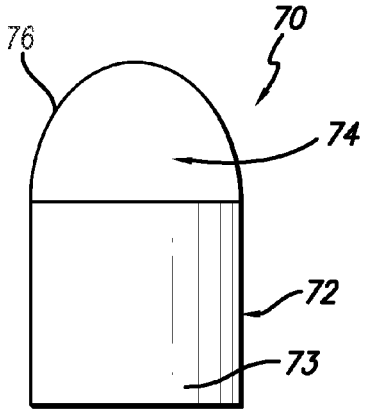
FIG. 7 is a perspective side view of an insert comprising the diamond bonded construction.

FIG. 7 illustrates an embodiment of a diamond bonded construction in the form of an insert 70 used in a wear or cutting application in a roller cone drill bit or percussion or hammer drill bit used for subterranean drilling. For example, such inserts 70 may be formed from blanks comprising a substrate 72 formed from one or more of the initial and/or final substrate materials 73 disclosed above, and a diamond bonded body 74 having a working surface 76. The insert substrate may include a portion of an initial substrate and a final substrate or may comprise only a final substrate. The blanks are pressed or machined to the desired shape of a roller cone rock bit insert.

Although the insert in FIG. 7 is illustrated having a generally cylindrical configuration with a rounded or radiused working surface, it is to be understood that inserts formed from diamond bonded constructions configured other than as illustrated and such alternative configurations are understood to be within the scope of this invention.

Figure 8:
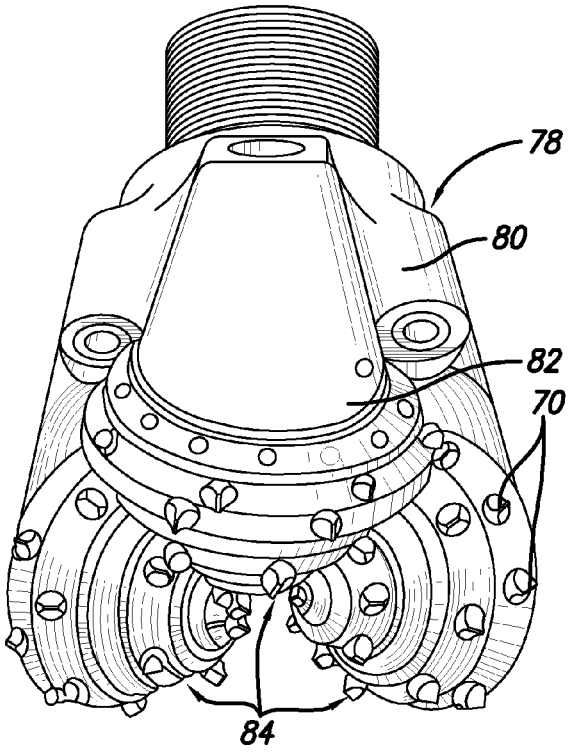
FIG. 8 is a perspective side view of a rotary cone drill bit comprising a number of the inserts of FIG. 7.

FIG. 8 illustrates a rotary or roller cone drill bit in the form of a rock bit 78 comprising a number of the wear or cutting inserts 70 disclosed above and illustrated in FIG. 7. The rock bit 78 comprises a body 80 having three legs 82, and a roller cutter cone 84 mounted on a lower end of each leg. The inserts 70 may be fabricated according to the method described above. The inserts 70 are provided in the surfaces of each cutter cone 84 for bearing on a rock formation being drilled.

Figure 9:
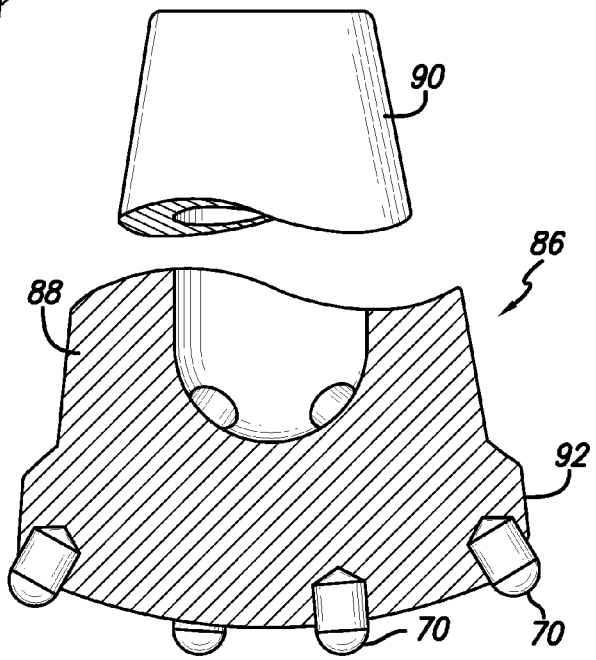
FIG. 9 is a perspective side view of a percussion or hammer bit comprising a number of the inserts of FIG. 8.

FIG. 9 illustrates the inserts 70 described above as used with a percussion or hammer bit 86. The hammer bit comprises a hollow steel body 88 having a threaded pin 90 on an end of the body for assembling the bit onto a drill string (not shown) for drilling oil wells and the like. A plurality of the inserts 70 is provided in the surface of a head 92 of the body 88 for bearing on the subterranean formation being drilled.

Other modifications and variations of diamond bonded constructions and methods of forming the same according to the principles of this invention will be apparent to those skilled in the art. It is, therefore, to be understood that within the scope of the appended claims, this invention may be practiced otherwise than as specifically described.

What is claimed is:

1. A diamond bonded construction comprising:

a diamond body comprising a matrix phase of intercrystalline bonded diamond, and a plurality of interstitial regions dispersed within the matrix phase;

a metallic substrate attached to the diamond body; and a metallic support attached to the substrate;

wherein the substrate and support each comprise a carbide-containing material, wherein the support has a material composition that is different from that of the substrate prior to sintering of the diamond body, and wherein a first population of the interstitial regions contain a catalyst material disposed therein provided from the metallic substrate and used to form the diamond body at high pressure/high temperature conditions, and wherein a second population of the interstitial regions are free of the catalyst material.

2. The construction as recited in claim 1 wherein the support has a carbide volume content that is the same as the carbide volume content in the substrate before sintering the diamond body by high pressure-high temperature process.

3. The construction as recited in claim 1 wherein the support has a carbide volume content that is different from the carbide volume content in the substrate before sintering the diamond body by high pressure-high temperature process.

4. The construction as recited in claim 1 wherein the substrate has a thickness that is less than about five times the thickness of the diamond body.

5. The construction as recited in claim 1 wherein the substrate has a thickness that is less than that of the diamond body.

6. The construction as recited in claim 1 wherein the carbide is tungsten carbide, and the volume content of tungsten carbide in the substrate prior to sintering the diamond body by high pressure-high temperature process is different than the volume content of tungsten carbide in the support.

7. The construction as recited in claim 6 wherein the substrate contains less tungsten carbide than the support.

8. The construction as recited in claim 6 wherein the substrate and support each comprise a material selected from Group VIII of the Periodic table, and wherein the volume content of such material is less in the support than in the substrate prior to sintering the diamond body.

9. The construction as recited in claim 1 wherein the substrate is interposed between the support and diamond body so that the support does not contact the diamond body.

10. The construction as recited in claim 1 wherein the support is in direct contact with the substrate.

11. The construction as recited in claim 1 wherein the substrate has a material composition that facilitates sintering of the diamond body during high pressure-high temperature conditions, and wherein the support has a material composition having a greater erosion resistance when placed in an end-use application as compared to the substrate.

12. A bit for drilling subterranean formations comprising a body and a number of cutting elements operatively attached thereto, wherein one or more of the cutting elements comprises the diamond bonded construction of claim 1, and wherein such diamond bonded construction is attached to the bit by the support.

13. The construction as recited in claim 1 wherein the substrate is integrally attached to the diamond body during a high pressure/high temperature process used to form the diamond body, and the support is attached after formation of the diamond body and attachment of the substrate.

14. The construction as recited in claim 1 wherein an interface surface between the diamond body and the substrate is nonplanar.

15. The construction as recited in claim 1 wherein an interface surface between the substrate and the support is nonplanar.

16. The construction as recited in claim 1 wherein the second population of interstitial regions free of the catalyst material extends a partial depth from a working surface of the diamond body, and wherein the first population of interstitial regions containing the catalyst material is adjacent the metallic substrate.

17. The construction as recited in claim 1 wherein the diamond body includes a replacement material disposed within the second population of interstitial regions substantially free of the catalyst material.

18. A diamond bonded construction comprising:

a diamond body comprising a matrix phase of intercrystalline bonded diamond and a plurality of interstitial regions dispersed within the matrix phase, wherein a catalyst material used to sinter the diamond body at high pressure-high temperature conditions is disposed in a population of the interstitial regions; and a final substrate attached to the diamond body, wherein the final substrate is different from an initial carbide-containing substrate comprising the catalyst material used to form the diamond body at high pressure/high temperature conditions and disposed in the interstitial regions;

wherein the final substrate is a carbide-containing material having a material composition that is different from that of the initial substrate prior to the formation of the diamond body.

19. The construction as recited in claim 18 wherein the final substrate has a carbide volume content that is the same as the carbide volume content in the initial substrate before sintering the diamond body by high pressure-high temperature process.

20. The construction as recited in claim 18 wherein the final substrate has a carbide volume content that is different from the carbide volume content in the initial substrate before sintering the diamond body by high pressure-high temperature process.

21. The construction as recited in claim 20 wherein the carbide is tungsten carbide, and wherein the final substrate has a greater volume content of tungsten carbide than that of the initial substrate.

22. The construction as recited in claim 20 wherein the diamond body includes a region comprising interstitial regions substantially free of the catalyst material.

23. The construction as recited in claim 22 wherein the region substantially free of a catalyst material extends a partial depth from a working surface of the diamond body.

24. The construction as recited in claim 22 wherein the diamond body includes a replacement material disposed within the interstitial regions substantially free of the catalyst material.

25. The construction as recited in claim 18 wherein an interface between the diamond body and the final substrate is nonplanar.

26. A bit for drilling subterranean formations comprising a body and a number of cutting elements operatively attached thereto, wherein one or more of the cutting elements comprises the diamond bonded construction of claim 18.

27. A method for making a diamond bonded construction comprising the steps of:

forming a sintered diamond bonded body by exposing a volume of diamond grains to high pressure-high temperature conditions in the presence of a catalyst material provided by an initial substrate positioned adjacent the volume of diamond grains, wherein the initial substrate comprises a carbide material and is attached to the diamond bonded body;

treating the diamond bonded body to remove the catalyst material from a region thereof, wherein a remaining region of the diamond bonded body comprises the catalyst material;

reducing the thickness of the initial substrate to less than five times the thickness of the diamond bonded body; and attaching a final substrate to the initial substrate, wherein the final substrate comprises a carbide material that is different from that of the initial substrate prior to the step of forming.

28. The method as recited in claim 27 wherein during the step of attaching, the final substrate has a carbide volume content that is the same as the carbide volume content of the initial substrate before the step of forming.

29. The method as recited in claim 27 wherein during the step of attaching, the final substrate has a carbide volume content that is different from the carbide volume content of the initial substrate before the step of forming.

30. The method as recited in claim 27 wherein during the step of reducing, the thickness of the initial substrate is reduced to less than the thickness of the diamond body.

31. The method as recited in claim 27 wherein the volume content of carbide in the final substrate is greater than that in the initial substrate.

32. The method as recited in claim 27 wherein the initial substrate and final substrate each comprise a material selected from Group VIII of the Periodic table.

33. The method as recited in claim 27 wherein the step of attaching is performed at high pressure/high temperature conditions.

34. The method as recited in claim 27 wherein an interface surface between the diamond body and initial substrate is nonplanar.

35. The method as recited in claim 27 wherein during the step of treating, the region removed of the catalyst material extends a partial depth from a working surface of the diamond bonded body.

36. The method as recited in claim 35 further comprising treating the region removed of the catalyst material to include a replacement material.

37. A method for making a diamond bonded construction comprising the steps of:

forming a sintered diamond bonded body by exposing a volume of diamond grains to high pressure/high temperature conditions in the presence of a catalyst material provided from an initial substrate, wherein the sintered diamond body comprises a matrix phase of bonded together crystals and interstitial regions dispersed within the matrix phase, wherein the catalyst material is disposed within a population of the interstitial regions, and wherein the initial substrate comprises a carbide material, and wherein during the step of forming the initial substrate is attached to the diamond body;

removing the initial substrate from the diamond body; and attaching a final substrate to the diamond body;

wherein the final substrate comprises a carbide material, wherein the initial substrate has a material composition that is different from that of the final substrate prior to the step of forming.

38. The method as recited in claim 37 wherein the initial substrate has a material construction that facilitates the step of forming, and wherein the final substrate has a material construction that provides a greater erosion resistance when placed in an end-use application when compared to the initial substrate.

39. The method as recited in claim 37 wherein during the step of attaching, the carbide volume content in the final substrate is the same as the carbide volume content in the initial substrate before the step of forming.

40. The method as recited in claim 37 wherein during the step of attaching, the carbide volume content in the final substrate is different that the carbide volume content in the initial substrate before the step of forming.

41. The method as recited in claim 37 wherein the the volume content of carbide in the final substrate is greater than that in the initial substrate before the step of forming.

42. The method as recited in claim 37 wherein the initial substrate and the final substrate each include a material selected from Group VIII of the Periodic table.

43. The method as recited in claim 42 wherein the volume content of Group VIII material in the final substrate is less than that in the initial substrate prior to the step of forming.

44. The method as recited in claim 37 wherein the step of attaching is performed under high pressure/high temperature conditions.

45. The method as recited in claim 37 further comprising the step of removing the catalyst material from a region of the diamond body to render the region substantially free of the catalyst material.

46. The method as recited in claim 45 further comprising treating the region substantially free of the catalyst material to include a replacement material.

47. The method as recited in claim 45 wherein the region substantially free of the catalyst material extends along a working surface of the diamond body.

* * * * *